United States Patent [19]

Clarke

[11] Patent Number: 4,554,099

[45] Date of Patent: Nov. 19, 1985

[54] OPAQUE GENERAL-PURPOSE CLEANING COMPOSITION COMPRISING ALCOHOL ESTERIFIED RESIN COPOLYMERS

[75] Inventor: David E. Clarke, Wirral, England

[73] Assignee: Lever Brothers Company, New York, N.Y.

[21] Appl. No.: 601,526

[22] Filed: Apr. 18, 1984

[30] Foreign Application Priority Data

Apr. 19, 1983 [GB] United Kingdom ..... 8310529

[51] Int. Cl.[4] ..... C11D 1/831; C11D 1/08

[52] U.S. Cl. ..... 252/551; 252/174.21; 252/174.22; 252/174.24; 252/550; 252/554; 252/559; 252/174.23

[58] Field of Search ..... 252/550, 551, 558, 559, 252/89.1, 174.21, 174.22, 174.23, 174.24, DIG. 2, DIG. 14, 554

[56] References Cited

U.S. PATENT DOCUMENTS

| | | | |
|---|---|---|---|
| 3,332,876 | 7/1967 | Walker | 252/551 |
| 4,220,548 | 9/1980 | Hashimoto et al. | 252/106 |
| 4,235,758 | 11/1980 | Dawson et al. | 252/544 |
| 4,239,662 | 12/1980 | Okumura et al. | 252/555 |
| 4,316,824 | 2/1982 | Pancheri | 252/551 |
| 4,368,146 | 1/1983 | Aronson et al. | 252/542 |
| 4,435,317 | 3/1984 | Gerritsen et al. | 252/547 |
| 4,448,704 | 5/1984 | Barby et al. | 252/91 |

FOREIGN PATENT DOCUMENTS

| | | |
|---|---|---|
| 66342 | 12/1982 | European Pat. Off. . |
| 2628976 | 1/1977 | Fed. Rep. of Germany . |
| 2840463 | 3/1980 | Fed. Rep. of Germany . |
| 204940 | 12/1983 | Fed. Rep. of Germany . |
| 55-66999 | 5/1980 | Japan . |
| 57-16098 | 1/1982 | Japan . |

*Primary Examiner*—Prince E. Willis

*Attorney, Agent, or Firm*—Milton L. Honig; James J. Farrell

[57] ABSTRACT

Thick and opaque general-purpose cleaning compositions having streak-free cleaning benefits are obtained by the use, in a composition comprising a nonionic detergent surfactant, an anionic detergent surfactant and an at least partially esterified resin, of a nonionic detergent surfactant with an HLB-value of between 3 and 10 and an anionic synthetic detergent in the form of its magnesium salt.

11 Claims, No Drawings

OPAQUE GENERAL-PURPOSE CLEANING COMPOSITION COMPRISING ALCOHOL ESTERIFIED RESIN COPOLYMERS

The present invention relates to liquid general-purpose cleaning compositions with a "streak-free" cleaning benefit, i.e. after cleaning a hard surface with such a cleaning composition the hard surface, when dry, does not show a residue in the form of visible, dull streaks to any significant degree. Such liquid general-purpose cleaning compositions with such a "streak-free" cleaning benefit have recently been described and claimed in our published European patent application No. 0066342. Such compositions comprise, as essential ingredients, a nonionic surfactant and an at least partially esterified resin. The nonionic surfactant has, according to this publication, an HLB (=Hydrophilic-Lipophilic-Balance) value of between about 10 and about 15, and shorter chain length nonionic surfactants are preferred over the longer alkyl chain length ones, particularly when the degree of alkoxylation in the nonionic surfactant is relatively low.

The at least partially esterified resin is, according to the above publication, either partly derived from natural sources such as rosin, or wholly synthetic, such as at least partially esterified derivatives of co-polymerisation products of mono-unsaturated aliphatic, cycloaliphatic or aromatic monomers having no carboxy groups and unsaturated dicarboxylic acids or anhydrides thereof.

The cleaning compositions according to this prior publication are preferably substantially electrolyte-free.

Cleaning compositions of the above type are clear, thin liquids; liquid general-purpose cleaning compositions that are thick and opaque, however, are often preferred by consumers because of their characteristic rheological properties, such as spreading properties in neat use, bubble suspension, pouring properties, etc., which influence consumer acceptability. The addition of an opacifying agent to the above clear, thin liquids, which does not contribute to the overall performance of the cleaning composition, increases the cost of the cleaning composition, and does not impart the required rheological properties thereto.

It has now been found that by using as the nonionic surfactant in the above composition a nonionic surfactant with a low HLB-value, in conjunction with the use of a magnesium salt of an anionic synthetic detergent, a structured opaque liquid composition can be obtained. By this combination of a low HLB-nonionic surfactant with a magnesium salt of an anionic synthetic detergent, structured opaque liquid general-purpose cleaning compositions are obtained at commercially viable active levels, whilst still retaining the "streak-free" benefit, and without detriment to overall cleaning performance. In this respect it is observed that according to our above prior publication it is preferred for optimum streak-free results that the nonionic surfactant provides a cloud point of the aqueous solution of the final composition above the temperature of normal use of the diluted solution. This can be achieved by a proper choice of the type of nonionic surfactant or by the co-use of another detergent surfactant, such as an anionic or amphoteric surfactant.

It is therefore surprising that the combination of a nonionic surfactant with an HLB-value below the minimum value as described in the above prior publication, with a magnesium salt of an anionic synthetic detergent results in a structured, opaque composition which still provides for the "streak-free" benefit, seeing that such combinations produce a cloud point of the aqueous solution of the final composition that is below the temperature of normal use of the diluted solution. The nonionic surfactant, or mixture of nonionic surfactants to be used in the present invention should have an HLB-value of 10 or below, and it may be as low as 3.0. Usually the HLB-value will range from 4 to 10, preferably from 5 to 9.8.

Examples of nonionic surfactants with an HLB-value within the above ranges may be amply found in M. Schick's textbook "Nonionic Surfactants", M. Dekker Inc., New York, 1967, and N. Schönfeldt's textbook "Surface-Active Ethyleneoxide Adducts", Pergamon Press, Oxford, England, 1969.

Typical examples of suitable nonionic surfactants are alkoxylated primary or secondary alcohols with 6–18 carbon atoms and a low alkoxylation degree. The alkoxylation agent can be ethylene oxide, propylene oxide or mixtures thereof. Such alkoxylated $C_6$–$C_{18}$ alcohols are for instance $C_9$–$C_{11}$ primary linear alcohol condensed with 2.5 moles of ethylene oxide, $C_6$–$C_{10}$ primary linear alcohol condensed with 3 moles of ethylene oxide, $C_{12}$–$C_{13}$ primary linear alcohol condensed with 2 moles of ethylene oxide, $C_{12}$–$C_{15}$ primary linear alcohol condensed with 2 or 3 moles of ethylene oxide, $C_{13}$–$C_{15}$ primary linear alcohol condensed with 2 or 3 moles of ethylene oxide, $C_{11}$–$C_{15}$ secondary linear alcohol condensed with 3 moles of ethylene oxide. Mixtures of nonionic surfactants with different HLB-values may equally be used, as long as the HLB-value of the mixture is within the above specified range. In general, from 0.01 to 99.495% by weight of the final composition of one or more nonionic surfactants will be present in the final composition. Usually, this amount will range from 2 to 30% by weight, preferably from 5 to 30%, particularly preferably from 5–25% and especially preferably from 7 to 25% by weight.

The magnesium salt of the anionic synthetic detergent to be used in the present invention can be a magnesium salt of the well-known types of anionic detergent surfactants, such as the $C_{10}$–$C_{18}$ alkylbenzene sulphonates, $C_{10}$–$C_{18}$ alkanesulphonates, sulphonated $C_{10}$–$C_{22}$ fatty acids or esters thereof, $C_8$–$C_{18}$ olefinsulphonates, di($C_6$–$C_{10}$ alkyl) sulphosuccinates, $C_{10}$–$C_{18}$ alkylsulphates, $C_{10}$–$C_{18}$ alkylethersulphates containing from 1 to 10 moles of ethyleneoxide. Further examples can be found in Schwartz-Perry "Surface Active Agents and Detergents", Vol. I (1949) and Vol. II (1958).

Preferred are the magnesium salts of $C_{10}$–$C_{18}$ alkylsulphates and of $C_{10}$–$C_{18}$ alkylethersulphates with from 1 to 10 moles of ethylene oxide.

In general, the final composition should comprise from 0.5 to 10% by weight of the magnesium salt of the anionic synthetic detergent, preferably from 1 to 7.5% by weight. The magnesium salt of the anionic synthetic detergent may be incorporated as such in the final composition, or may be formed by in situ neutralisation of the anionic synthetic detergent in acid form with a suitable neutralizing magnesium compound such as magnesium-oxide, -hydroxide, -carbonate, -sulphate, etc. The magnesium salt of the anionic synthetic detergent may also be formed in situ by the addition of a magnesium salt such as magnesium sulphate to the alkalimetal ammonium or alkylolamine salt of the anionic synthetic detergent in the composition.

The at least partially esterified resin to be used in the present invention can be either partly derived from natural sources or wholly synthetic in origin. An example of a resin partly derived from natural sources is the at least partially esterified adduct of rosin and an unsaturated dicarboxylic acid or anhydride.

Examples of wholly synthetic resins are at least partially esterified derivatives of co-polymerisation products of mono-unsaturated aliphatic, cycloaliphatic or aromatic monomers having no carboxy groups and unsaturated dicarboxylic acids or anhydrides thereof. Normally, these copolymers will contain equimolar proportions of the monomer and the dicarboxylic acid or anhydride, but copolymers with higher ratios or monomer to dicarboxylic acid or anhydride are also suitable, provided they can be solubilized in the liquid medium.

Typical examples of suitable copolymers are copolymers of ethylene, styrene, and vinylmethylether with maleic acid, fumaric acid, itaconic acid, citraconic acid and the like and the anhydrides thereof. Preferred are the styrene/maleic anhydride copolymers.

The partly natural or wholly synthetic resins are at least partially esterified with a suitable hydroxyl containing compound. Examples of suitable hydroxyl containing compounds are aliphatic alcohols such as methanol, ethanol, propanol, iso-propanol, butanol, isobutanol, sec. butanol, ethylhexanol and decanol, higher primary alcohols, glycol ethers such as the butyl ether of ethylene glycol and polyols such as ethylene glycol, glycerol, erythritol, mannitol, sorbitol polyethylene glycol, polypropylene glycol, and so on. The choice of the esterification agent and the degree of esterification depend upon the solubility requirements of the at least partially esterified resin in an (alkaline) liquid medium of the type hereabove described and the viscosity profile of the compositions of the invention in practical use. The choice of the esterification agent and the degree of esterification cation also influence the sensitivity of the at least partially esterified resin to hardness ions both in the compositions of the invention and when for example these are diluted with hard water, either for large surface area cleaning or during rinsing. For optimum streak-free results the choice of esterification agent and the degree of esterification should be such as to give an at least partially esterified resin which when used in the compositions of the invention is not precipitated either by the magnesium ions of the magnesium anionic synthetic active or by water hardness ions when the composition is diluted for general use. It is to be understood that the choice of the esterification agent does not embrace the nonionic surfactants mentioned above.

The at least partial esterification is to be understood to imply that at least 5%, preferably at least 10% and especially preferably at least 20%, particularly 25% of the free carboxy groups of the resin are esterified with the hydroxyl group containing compound. The esterification can also be complete, i.e. 100% of the free carboxy groups are esterified. It is to be understood that the latter compound does not embrace the nonionic detergent surfactants mentioned above.

Typical examples of at least partially esterified resins for use in the present invention are partially esterified adducts of rosin with maleic anhydride, such as the products SR 83, SR 88, SR 91 (ex Schenectady Chemicals), having an esterification degree of about 65, about 50 and about 50% resectively; Durez 17211 and Durez 15546 (ex Hooker Electro-Chemical Co), having an esterification degree of about 60 and 65% respectively; Alresat KM 140 (ex Hoechst), having an esterification degree of about 40%; Pentalyn 255 (ex Hercules); SMA 1140 H, SMA TM 9123 and SMA TM 7092 (ex Arco Co), having an esterification degree of about 70, about 50 and about 60% respectively; Ubatol R 300 and R 400 (ex Staley), styrene-based copolymers having an esterification degree of about 40%; Shanco 334 (ex Shanco Plastics), a modified polyester resin having an esterification degree of about 40%; partially esterified copolymers of styrene with maleic anhydride, esterified with lower alkanols, such as Scripset 520, Scripset 540 and Scripset 550, (ex Monsanto), having an esterification degree of about 20, about 45 and about 45% respectively, and polyvinyl-methylether/maleic anhydride copolymers, partially esterified with butanol, such as Gantrez ES 425 (ex GAF Corp.), having an esterification degree of about 50%.

Suitable examples of the preferred esterified resins are the partially lower alkanol esterified copolymers of sytrene with maleic anhydride, e.g. Scripset 540 and 550, the esterifying alkanol in the latter being sec.-butanol (ex Monsanto), partially esterified adducts of rosin with maleic anhydride, e.g. SR 91 (ex Schenectady Chemicals) and Alresat KM 140 (ex Hoechst), modified polyester resins, e.g. Shanco 334 (ex Shanco Plastics) and polyvinylmethylether/maleic anhydride copolymers, partially esterified with butanol, e.g. Gantrez ES 425 (ex GAF Corp).

Mixtures of various partially or fully esterified resins may also be used, as well as mixtures of partially or fully esterified an non-esterified resins. Thus, mixtures of Scripset 550 and SR 91, Scripset 550 and Shanco 334, and SR 91 and Shanco 334 give good results, as well as mixtures of Scripset 550 and SMA 2000A (which is a non-esterified styrene-maleic anhydride copolymer).

The molecular weight of the resins of the invention may vary from a thousand to a few million. The at least partially esterified resins should have a sufficient solubility in a neutral or alkaline liquid medium, preferably in an aqueous medium. The partially esterified resin may if necessary be hydrolysed and subsequently neutralized or made alkaline so that in normal use it is present in the compositions of the invention in soluble form as the alkalimetal, ammonium or substituted ammonium or alkaline earth metal salt, or as the salt of a suitable amine or mixtures thereof. This of course does not apply to the fully esterified resins.

In general, the compositions of the invention will contain from 0.005 to 20%, usually from 0.1 to 15% and preferably from 0.5 to 10% by weight of the at least partially esterified resin. The at least partially esterified resin may be incorporated in the final composition after having been prepared separately, or it may be prepared in situ. In the latter case, however, a careful control and adjustment of the amount of esterifying hydroxy compound is necessary.

The compositions may furthermore contain optional ingredients such as preservatives, bactericides, hydrogen peroxide, thickening agents, organic buffers such as the alkanolamines, colouring agents, perfumes, plasticizers, low amounts of a buffer such as alkalimetal-borates, -carbonates, or a builder salt such as phosphates, citrates, NTA, EDTA, Dequest, etc. The compositions of the invention are normally alkaline; if necessary, the pH is adjusted to alkaline values by means of a suitable alkaline material.

The compositions of the invention are structured liquids, which have suspending properties, i.e. they can suspend insoluble particulate solids such as particulate abrasive materials e.g. calcites, particulate insoluble dyes and pigments and so on. The "neat" composition may be solvent-free (solvent meaning in this respect also water), in which case the nonionic or mixture of nonionic surfactants form the liquid medium, or it may comprise a compatible liquid medium.

The compatible liquid medium may consist of water, or mixtures of water and one or more water-miscible organic solvents. Typical examples of such solvents are the lower aliphatic water-miscible alcohols such as ethanol, propanol, isopropanol, butanol and so on. Other alcohols, such as tetrahydrofurfurol, may also by used. Glycols, such as ethylene- and propyleneglycol, and glycolethers, such as the mono- and dimethyl, -propyl-, -isopropyl-, -butyl-, -isobutylethers of ethyleneglycol, di- and tri-ethyleneglycol may also be used. Analogous propyleneglycolethers may also be used.

In general, the liquid medium can make up from 0.505 to 99.495% by weight of the final composition. Normally this will be from 50 to 96.6%, and preferably from 55 to 91.5% by weight of the final composition.

The products of the invention may be used as such, i.e. neat, or they may be diluted with water before use to a concentration of generally from 0.1 to 10%.

The invention will now be illustrated by way of example.

EXAMPLE 1

The following compositions were prepared:

| | % by weight | | | | |
|---|---|---|---|---|---|
| | A | B | C | D | E |
| $C_9$–$C_{11}$ linear primary alcohol, condensed with 2.5 moles of ethylene oxide (HLB = 8.1) | 8 | 7.0 | 7.5 | 4 | 4 |
| $C_6$–$C_{10}$ linear primary alcohol, condensed with 3 moles of ethylene oxide (HLB = 9.8) | — | — | — | 4 | — |
| Coconut fatty acid diethanolamide | — | — | — | — | 4 |
| Magnesium lauryl sulphate | 2 | — | 1 | — | 2 |
| Magnesium laurylethersulphate (containing 2 moles of ethylene oxide) | — | 2.5 | 1.5 | 2 | — |
| Partial sec.-butanol ester of a styrene maleic anhydride copolymer, | 1 | 0.7 | 0.7 | 0.5 | 0.75 |

-continued

| | % by weight | | | | |
|---|---|---|---|---|---|
| | A | B | C | D | E |
| neutralized to the sodium salt (av. mol. wt. ~ 10,000; theor. acid number ~ 190); esterification degree ~ 45%) | | | | | |
| Demineralized water | | | | | |

These products were opaque, structured liquids.

EXAMPLE 2

Repeating Example 1 (B), using the following nonionic surfactants instead of the nonionic surfactant used in Ex. 1 (B) equally gave opaque, structured liquids:

F: $C_{13}$–$C_{15}$ linear primary alcohol, condensed with 2 moles of ethylene oxide (HLB=5.9).

G: $C_{13}$–$C_{15}$ linear primary alcohol, condensed with 3 moles of ethylene oxide (HLB=7.8)

H: $C_{12}$–$C_{13}$ linear primary alcohol, condensed with 2 moles of ethylene oxide (HLB=6.2)

K: $C_{12}$–$C_{15}$ linear primary alcohol, condensed with 2 moles of ethylene oxide (HLB=5.6)

L: $C_{12}$–$C_{15}$ linear primary alcohol, condensed with 3 moles of ethylene oxide (HLB=7.8).

EXAMPLE 3

The following opaque, structured liquid was prepared:

| | % by weight |
|---|---|
| $C_9$–$C_{11}$ linear primary alcohol, condensed with 2.5 moles of ethylene oxide (HLB = 8.1) | 5 |
| Sodium dodecyl benzene sulphonate | 1.25 |
| Sodium lauryl ether sulphate (containing 2 moles of ethylene oxide) | 1.25 |
| Partial sec.-butanol ester of a styrene maleic anhydride copolymer as in Example 1 | 0.7 |
| Perfume | 1.0 |
| Magnesium sulphate | 0.4 |
| Demineralized water | q.s. |

Leaving out the magnesium sulphate resulted in an unstructured liquid.

EXAMPLES 4–11

The following compositions are opaque, structured liquids

| | % by weight | | | | | | | |
|---|---|---|---|---|---|---|---|---|
| Examples | 4 | 5 | 6 | 7 | 8 | 9 | 10 | 11 |
| $C_9$–$C_{11}$ linear primary alcohol, condensed with 3 moles of ethylene oxide (HLB = 8.8) | 3.5 | 7 | — | — | — | — | — | — |
| $C_9$–$C_{11}$ linear primary alcohol, condensed with 2.5 moles of ethylene oxide (HLB = 8.1) | 3.5 | — | 3.5 | 2.0 | — | 7.0 | 7.0 | 5.0 |
| $C_9$–$C_{11}$ linear primary alcohol, condensed with 5 moles of ethylene oxide (HLB = 11.6) | — | — | 3.5 | — | — | — | — | — |
| $C_{10}$ linear primary alcohol, condensed with 4 moles of ethylene oxide (HLB = 10.5) | — | — | — | 5.0 | 5.0 | — | — | — |
| $C_{12}$ linear primary alcohol, condensed with 4 moles of ethylene oxide (HLB = 9.7) | — | — | — | — | 2.0 | — | — | — |
| Magnesium laurylether sulphate (containing 2 moles of ethylene oxide) | 2.0 | — | 1.0 | 1.0 | 1.0 | — | — | — |
| Magnesium lauryl sulphate | 0.5 | 2.5 | — | — | — | — | — | — |
| Sodium laurylether sulphate (containing 2 moles of ethylene oxide) | — | — | — | — | — | 2.5 | — | 1.25 |
| Sodium $C_{13}$–$C_{17}$ paraffin sulphonate | — | — | — | — | 0.5 | — | 2.5 | 1.25 |
| Partial sec.-butanol ester of a styrene-maleic anhydride copolymer as in Example 1 | 0.7 | 0.7 | 0.7 | 0.7 | 0.7 | 1.0 | 0.7 | 0.7 |
| Magnesium sulphate | — | — | 0.4 | 0.3 | 0.4 | 0.5 | 0.35 | 0.45 |

-continued

| Examples | % by weight | | | | | | | |
|---|---|---|---|---|---|---|---|---|
| | 4 | 5 | 6 | 7 | 8 | 9 | 10 | 11 |
| Perfume | — | — | 0.3 | 0.4 | 0.4 | 0.4 | 0.4 | 0.4 |
| Demineralized water | q.s | q.s | q.s | q.s | q.s | q.s | q.s | q.s |
| Viscosity (in cP at 21 $sec^{-1}$) | 85 | 105 | 45 | 135 | 70 | 210 | 220 | 170 |
| at 11 $sec^{-1}$) | 130 | 155 | 60 | 210 | 100 | 355 | 370 | 285 |

All these products were viscous, opaque, structured liquids and they gave good streak-free end-results at 10 g/l in 40° FH. water at room temperature.

EXAMPLE 12

The following product was prepared:

| | % by weight |
|---|---|
| $C_9/C_{11}$ alcohol (a mixture of linear and branched $C_9$ and $C_{11}$ alcohol), condensed with 2.6 moles of ethylene oxide (HLB = 8.3) | 7.0 |
| Sodium laurylether sulphate containing 2 moles of ethylene oxide | 2.5 |
| The partially esterified resin of Example 1 | 0.7 |
| Ammonia | 0.05 |
| Formaldehyde | 0.04 |
| Magnesium sulphate | 0.4 |
| Perfume | 0.6 |

This product was a strongly structured liquid and gave good streak-free end-results at 10 g/l in 40° FH water at room temperature.

I claim:

1. An opaque liquid general-purpose cleaning composition having non-streak cleaning properties comprising
   (a) from 0.01–98% by weight of a nonionic detergent surfactant or mixture of nonionic surfactants having an HLB-value of between 3 to 10,
   (b) 0.005–20% by weight of an at least 5% alcohol esterified copolymer formed from an unsaturated monomer and an unsaturated dicarboxylic acid or -anhydride,
   (c) from 0.5–10% by weight of a magnesium salt of an anionic synthetic detergent, the balance being a compatible liquid medium consisting of water or mixtures of water and one or more water-miscible organic solvents.

2. A composition according to claim 1, wherein the nonionic or mixture of nonionic surfactants has an HLB-value of between 5 and 9.8.

3. A composition according to claim 1, wherein the magnesium salt is a magnesium salt of a $C_{10}$–$C_{18}$ alkyl sulphate or $C_{10}$–$C_{18}$ alkylether sulphate with 1–10 moles of ethylene oxide.

4. A composition according to claim 1, comprising from 1 to 7.5% by weight of the magnesium salt of the anionic synthetic detergent.

5. A composition according to claim 1, comprising 5–30% by weight of the nonionic detergent surfactant and 0.1–15% by weight of the at least 5% alcohol esterified resin copolymer.

6. A composition according to claim 5, comprising 5–25% by weight of the nonionic detergent surfactant and 0.5–10% by weight of the at least 5% alcohol esterified resin copolymer.

7. A composition according to claim 1, in which the esterification degree is at least 10%.

8. A composition according to claim 1, in which the esterification degree is at least 20%.

9. A composition according to claim 1, in which the at least 5% alcohol esterified resin copolymer is derived from an adduct of rosin and an unsaturated dicarboxylic acid or anhydride.

10. A composition according to claim 1, in which the at least 5% alcohol esterified resin copolymer is derived from a copolymer of a mono-unsaturated aliphatic, cycloaliphatic or aromatic monomer having no carboxy groups, and an unsaturated dicarboxylic acid or anhydride.

11. A composition according to claim 10, in which the at least 5% alcohol esterified resin copolymer is a copolymer of styrene with maleic anhydride, partially esterified with secondary butanol.

* * * * *